US005265995A

United States Patent [19]

Beck

[11] Patent Number: 5,265,995

[45] Date of Patent: Nov. 30, 1993

[54] TRACTOR-LOADER BACKHOE

[76] Inventor: John W. Beck, Rte. 1, Box 308, Pawnee, Ill. 62558

[21] Appl. No.: 861,347

[22] Filed: Mar. 30, 1992

Related U.S. Application Data

[63] Continuation of Ser. No. 663,676, Mar. 4, 1991, abandoned.

[51] Int. Cl.[5] ..... E02F 3/28

[52] U.S. Cl. ..... 414/694; 180/331; 180/89.13; 280/765.1; 212/189

[58] Field of Search ..... 414/694, 695.5; 180/326, 327, 331, 89.13; 280/765.1, 759; 212/189

[56] References Cited

U.S. PATENT DOCUMENTS

| | | | |
|---|---|---|---|
| 2,375,264 | 5/1945 | Wagner et al. | 212/189 |
| 2,750,204 | 6/1956 | Ohrmann | 212/189 X |
| 3,279,622 | 10/1966 | Person | 212/189 |
| 3,606,047 | 9/1971 | Schaeff | 414/694 |
| 3,612,310 | 10/1971 | Schaeff | 414/694 |
| 3,999,670 | 12/1976 | Weyhausen | 414/694 |
| 4,143,778 | 3/1979 | Ullman | 414/694 |
| 4,147,262 | 4/1979 | Umeda et al. | 414/697 X |
| 4,395,191 | 7/1983 | Kaiser | 414/694 |
| 4,725,187 | 2/1988 | Morelli | 414/694 X |
| 4,950,127 | 8/1990 | Weyer | 414/694 |
| 5,002,454 | 3/1991 | Hadank et al. | 414/695.5 |

FOREIGN PATENT DOCUMENTS

| | | | |
|---|---|---|---|
| 1209149 | 10/1970 | United Kingdom | 414/694 |
| 1381091 | 1/1975 | United Kingdom | 414/694 |

*Primary Examiner*—Michael S. Huppert
*Assistant Examiner*—Donald W. Underwood
*Attorney, Agent, or Firm*—Robert A. Brown

[57] ABSTRACT

A front end loader and backhoe construction machinery vehicle. The backhoe and operator's cab are formed from a unitary construction wherein the cab has an undercarriage adaptable to rotate a complete revolution of 360 degrees on a bearing arrangement secured to supporting structure mounted on a main frame of the vehicle. A system of hydraulic controls is effective to raise, lower, telescope and rotate the boom, dipperstick and bucket of the backhoe. Sensor means are provided to disenable operation of the backhoe assembly if it has insufficient clearance with the front end of the machine during rotation of the cab and backhoe assembly. The control system is effective to raise, lower and rotate the front end loader assembly. There is provided a front end and a rear end stabilizing assembly so as to permit the vehicle to work on a stable, rigid platform during digging and moving of earth by the backhoe assembly.

20 Claims, 3 Drawing Sheets

TRACTOR-LOADER BACKHOE

This application is a continuation of application Ser. No. 07/663,676, filed Mar. 4, 1991, abandoned.

BACKGROUND OF THE INVENTION

The present invention relates generally to construction machinery and more particularly to a loading and excavating machine adapted to be mounted on a wheeled type vehicle and having the capability of rotating an excavating backhoe attachment throughout 360 degrees.

DESCRIPTION OF THE PRIOR ART

In the past there have been many attempts to design and build earth moving machines that cut and dig soil at one location, pick up the loosened soil, load it into a receptacle, such as a bucket or a truck, and transport the loaded soil for use or disposal at another location. Various types of machines, such as endless track bulldozers and crawler loaders, wheel loaders, excavators and self-propelled scraper units are used to cut and dig earth, load and move it to a desired job site. Each of these machines may be used for a special purpose. For example, a bulldozer scrapes soil and pushes it to a location for loading and spreading it over a new area. Wheel loaders usually are equipped with a bucket and scoop loose earth into its bucket and lift or load it into a truck or other means for transportation to a new area of work. Excavators most often are used to dig trenches and leave the soil for later filling in or may load the excavated earth into trucks for movement away from a job site. Scrapers are self-loading haulage vehicles employed in road building applications where it is necessary to cut and move large volumes of earth so as to adapt terrain to a generally level configuration.

For the most part, each of these machines is limited to operate in a certain manner, such as a straight ahead bulldozer with little ability to angle from rectilinear movement. A wheel loader may rotate on its axis up to but not beyond 180 degrees. Examples of prior art earthmoving machines are founded in U.S. Pat. Nos. 3,999,670 to Weyhausen; 4,147,262 to Umeda; and 4,395,191 to Kaiser. Weyhausen '670 discloses a swivel joint between the main arm of an excavator and its jib. The swivel arrangement acts to permit the chassis to sit on a slope and allow the shovel to dig vertically.

Umeda '262 discloses a loader having front and rear wheeled frames interconnected by steering cylinders that permit the front and rear frames to rotate relative to each other.

Kaiser '191 discloses an excavator having pivotal front and rear legs that extend longitudinally from undercarriage cab supporting structure. The legs are adaptable to pivot outwardly so that the machine can straddle a trench. The oppositely disposed legs may be on substantially the same level or at unequal levels to adapt to terrain having a steep profile.

Other examples of the state of the art may be found in U.S. Pat. Nos. 4,329,796; 3,567,.049; 4,049,138; and 4,360,311.

SUMMARY OF THE INVENTION

Accordingly, it is a primary object of the present invention to provide an improved construction machinery vehicle that combines a front end loader attachment with a backhoe attachment connected to a cab that rotates a complete revolution of three hundred sixty degrees.

It is a further object of the present invention to provide a combined front end loader and backhoe apparatus that includes front and rear end stabilizing means adaptable for extendible and retractive movement.

An additional object of the present invention is to provide a construction machinery vehicle having a unitary cab and backhoe arrangement capable of revolving through a complete circle of three hundred sixty degrees.

It is still a further object of the present invention to provide a construction machinery vehicle having an operator's control station adaptable to face forwardly or rearwardly for selectively steering the vehicle, manipulation of the front loader bucket, or operation of the backhoe attachment.

These and other objects are achieved in accordance with the present invention wherein there is provided an improved excavator and backhoe apparatus having a main frame supported by rotatable wheel means, a front end loader assembly secured to a forward portion of the main frame, a circular bearing arrangement secured on and supported by the main frame, a rotatable cab assembly disposed upon the bearing arrangement and adaptable to rotate thereon three hundred sixty degrees, a backhoe assembly secured to a portion of the rotatable cab assembly and adaptable to rotate as a unit therewith, and front and rear stabilizing assemblies adaptable to extend outwardly to engage ground level and thereby provide a stable and rigid platform during operation of the loader assembly and the backhoe assembly.

BRIEF DESCRIPTION OF THE DRAWINGS

The foregoing and other characteristics, objects, features and advantages of the present invention will become more apparent upon consideration of the following detailed description, having reference to the accompanying figures of the drawings, wherein.

DESCRIPTION OF A PREFERRED EMBODIMENT

Figure 1:
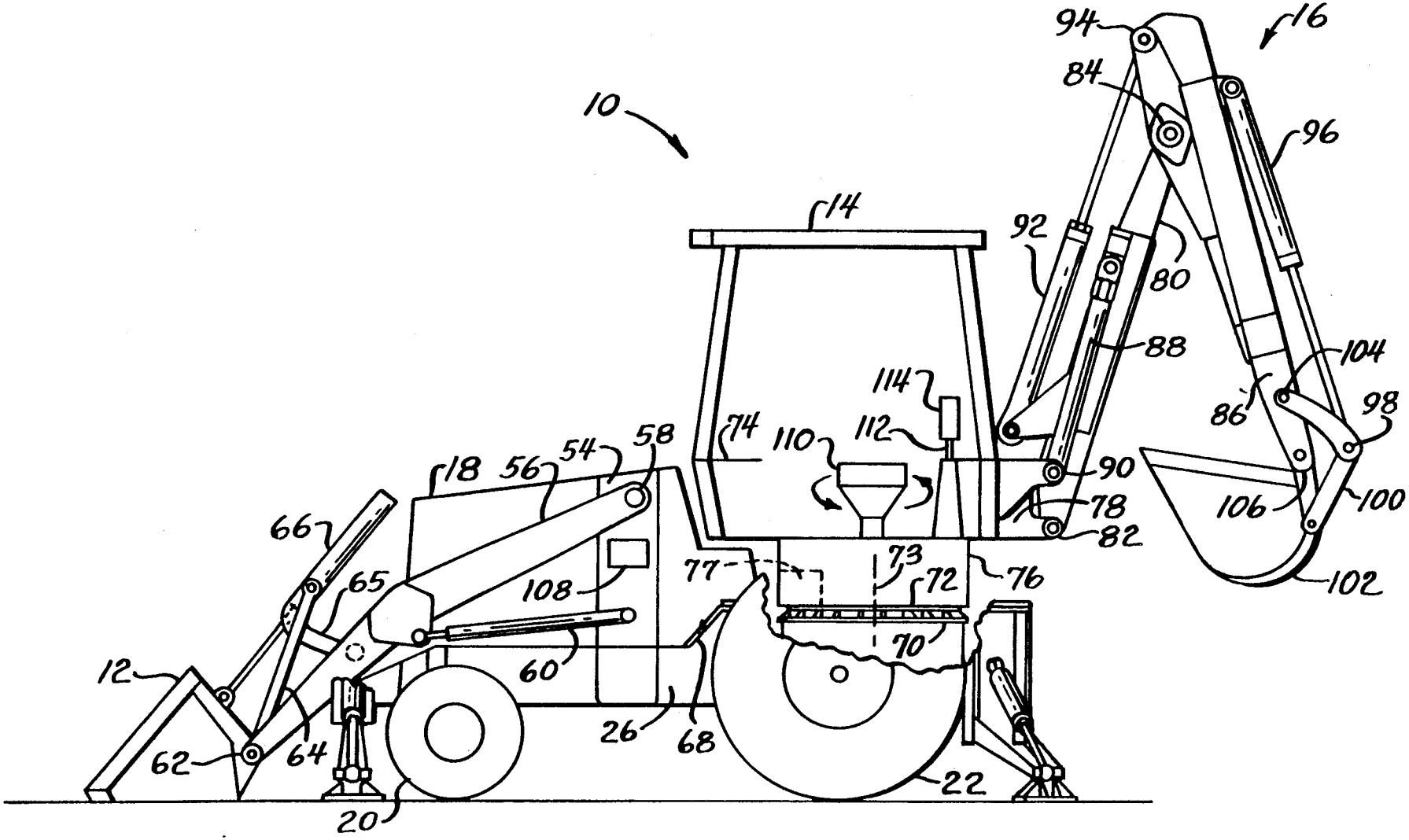
FIG. 1 is a side elevational view of a construction machinery vehicle including a combination backhoe excavator and front end loader apparatus of the invention.

Referring now to FIGS. 1–6 of the drawings, and more particularly to FIG. 1, there is shown an earthmoving vehicle or excavator and backhoe apparatus generally identified by the reference numeral 10. The apparatus 10 includes a loading bucket 12 at the front end of the vehicle, a rotatable cab 14, and an excavator-backhoe assembly, referred to generally by reference numeral 16. The apparatus 10 includes an engine enclosure 18 disposed at the front, end of the vehicle wherein is mounted an engine (not shown) that supplies selective motive power by means of hydraulic or other suitable engine driven power means, as is well known in the operation of construction machinery vehicles, to the bucket 12, the cab 14, the assembly 16 and to front wheels 20 and rear wheels 22 for propelling or moving the vehicle along ground level. In addition, the engine serves to function as a counterweight to the backhoe assembly 16 during machine operation thereof.

Figure 4:
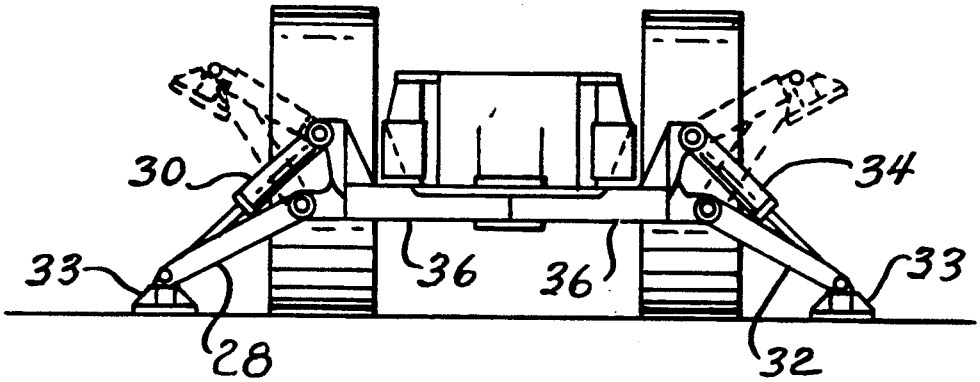
FIG. 4 is a rear end elevational view of a portion of the apparatus wherein the stabilizing means is depicted in alternate positions of ground contact and retracted during movement of the machine from a first to another working location.
Figure 5:
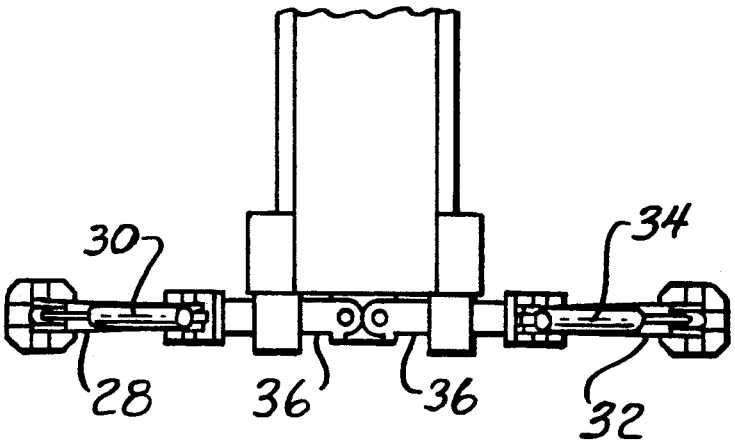
FIG. 5 is a top plan view of the stabilizing means shown in FIG. 4 including means for pivotal operation thereof.

Next referring specifically to FIGS. 2–5, a rear end stabilizing assembly 24 is disposed upon a main frame means 26 that supports the various components of the apparatus. The stabilizing assembly 24 comprises a first stabilizing arm 28 pivotally mounted on the main frame 26 adaptable to be operated by a hydraulic or other suitable powered cylinder means 30. Similarly, a second stabilizing arm 32 is pivotally mounted on the main frame 26 and is adaptable to be selectively operated by a hydraulic or other suitably powered cylinder means 34. It will be noted that first and second stabilizing arms 28, 32 include horizontal beam members 36 adaptable to extend and retract outwardly and inwardly in a direction normal to a longitudinal axis 38 of the vehicle 10. Each arm 28, 32 has a foot pad 33 pivotally connected at a respective outer end suitable to engage a surface of earth during manipulation of either the bucket 12 or the backhoe 16. The capability of extending and retracting the stabilizing arms 28 and 32 makes it possible to provide additional stability for the machine when the arms 28 and 32 are fully extended and in contact with the ground during operation of the bucket 12 and/or the backhoe 16. In addition, when the arms 28 and 32 are in a fully retracted position and pivoted upwardly to a travel position as shown in FIG. 4, the vehicle 10 may move along normal avenues of travel without interruption with any roadside obstacles. It will be further noted that horizontal beams 36 as shown in FIG. 5 may be pivotally connected at their inner ends to the main frame or other suitable supporting means so as to permit horizontal positioning backwardly from the vehicle 10 and thereby provide greater stability during operation of the backhoe 16.

Figure 2:
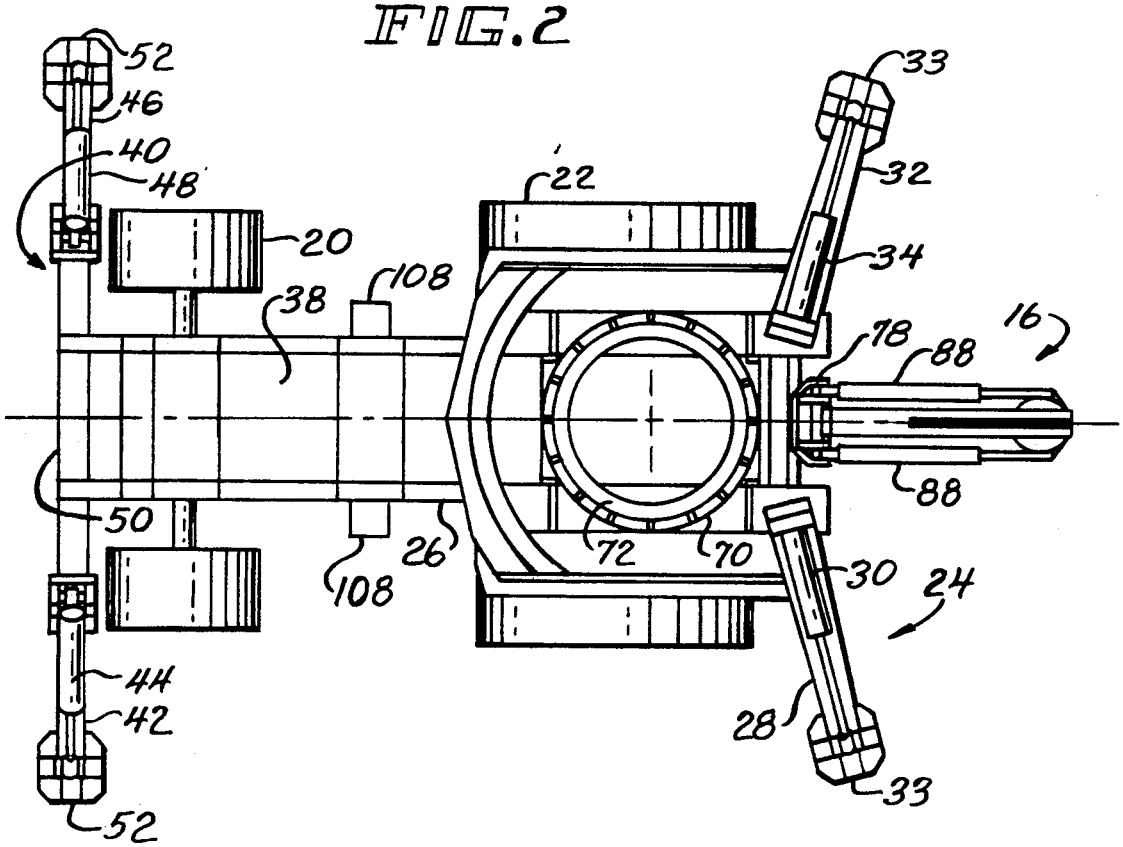
FIG. 2 is a top plan view of a portion of the combination backhoe excavator and front end loader apparatus including means for rotation of the cab and backhoe throughout a complete revolution of 360 degrees.
Figure 3:
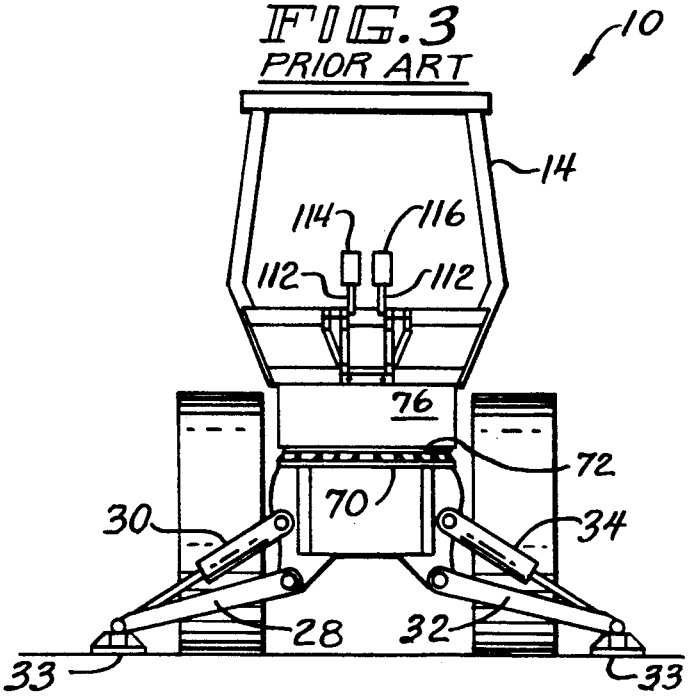
FIG. 3 PRIOR ART
FIG. 3 is a rear end elevational view of a portion of the apparatus showing a conventional or prior art stabilizing means in contact with ground level.
Figure 6:
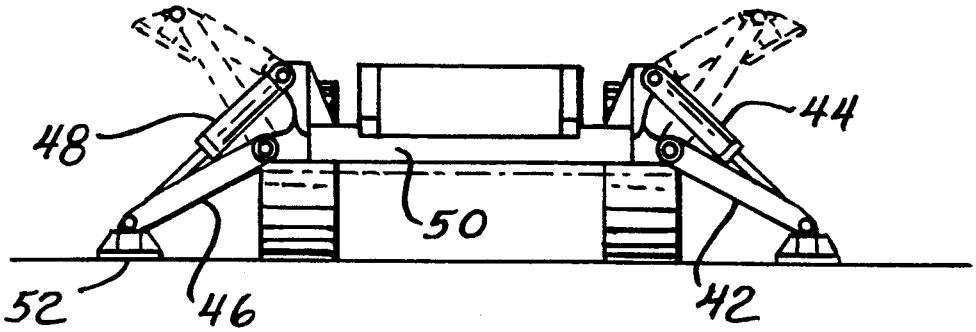
FIG. 6 is a front end elevational view of a portion of the apparatus in which the stabilizing means is shown in alternate positions of ground contact and retracted during movement of the machine from a first to another working location.

Now referring to FIGS. 2 and 6, there is shown a front end stabilizing assembly 40 disposed upon a forward portion of the main frame 26. The front end stabilizing assembly 40 comprises a third stabilizing arm 42 pivotally mounted on the main frame 26 adapted to be selectively operated by a hydraulic or other suitably powered cylinder means 44. Similarly, a fourth stabilizing arm 46 is pivotally mounted on the main frame 26 and is adaptable to be selectively operated by a hydraulic or other suitably powered cylinder means 48. The third and fourth stabilizing arms 42, 46 are pivotally connected at their inboard ends to a pair of front, horizontal cross beams 50 secured to the main frame 26. Each arm 42, 46 has a foot pad 52 pivotally connected at a respective outer end suitable to engage a surface of earth during manipulation of either the bucket 12 or the backhoe 16. The cross beams 50 are adaptable to extend and retract outwardly and inwardly in a direction normal to the longitudinal axis 38 of the vehicle 10. The capability of extending and retracting the stabilizing arms 42, 46 makes it possible to provide additional stability for the machine when the arms 42, 46 are fully extended and through pads 52 in contact with the ground during operation of the bucket 12 and/or the backhoe 16. The beams 50 and arms 42, 44 are adaptable to be fully retracted and pivoted upwardly to a travel position as shown in FIG. 6 to permit vehicle travel along a road and avoid obstacles therealong.

It will be noted the front and rear assemblies 40, 24 when individually adjusted and disposed in a ground engaging mode cooperate to provide a stable, rigid platform that is adaptable to any profile of terrain or non-level earth so as to permit a most efficient manipulation of the bucket 12 or backhoe 16 in order to dig, move or handle a working quantity of earth.

As shown in FIG. 1, the apparatus 10 includes a vertical frame structure 54 that is disposed over and envelopes the engine enclosure 18 and is suitably secured as by welding to the main frame 26. The vertical frame 54 provides means for pivotally mounting one end of a lift arm 56 at a hinge pin connection 58. The lift arm 56 is preferably constructed to have a bent portion substantially intermediate its ends to form a sort of elbow and is sometimes referred to as a bellcrank lever. A lift arm cylinder 60 has a first end pivotally connected to the elbow portion of the lift arm 56 and a second end pivotally connected to the vertical frame 54 at a location substantially below the hinge pin connection 58. The bucket 12 has its rearward side or backsheet pivotally connected at a bucket pin hinge 62 to a forwardly extending end of the lift arm 56. A bucket link 64 has one end pivotally connected to the bucket hinge 62 and its other end pivotally connected to a lift arm link 65 pivotally hinged to the lift arm 56. A bucket cylinder 66 has one end pivotally connected to the backsheet of the bucket 12 and its other end pivotally hinged to the connection between the bucket link 64 and lift arm link 65.

It will be noted that the heretofore described components comprise one-half of the structure connected to the bucket 12 and the other half is not shown in the interests of simplicity. It will be seen that extension or retraction of lift arm cylinders 60 will cause the lift arms 56 to raise or lower the bucket 12 and extension or retraction of the bucket cylinders 66 will cause the bucket to rotate forwardly or backwardly so as to be placed in a desirable position for handling a workload.

Referring more particularly to FIGS. 1 and 2, the vehicle 10 includes a mounting pad 68 suitably secured as by welding to the main frame 26. The mounting pad 68 has secured thereto and supports a bearing adapter means 70 which in turn supports and has secured therein a circular bearing arrangement 72. The cab 14 comprises a lower portion rotary tub member or bottom side means 74 having a circular undercarriage 76 that is adaptable to rest upon the bearing arrangement 72 and rotate thereabout. A hydraulic or other suitable motor means powered by the engine and controlled by an operator in the cab 14 is effective to at times rotate the undercarriage 76 on and about the bearing arrangement 72 so as to cause the cab 14 to revolve 360 degrees about a vertical centerline or axis 73 of undercarriage 76. The rotary tub 74 has secured thereto a backhoe bracket 78 which serves to support the backhoe assembly 16.

The backhoe assembly 16 comprises a telescopic boom 80 having a first end pivotally connected to a lower pin hinge 82 of backhoe bracket 78 and its other end pivotally connected by a hinge pin 84 to an intermediate portion of a telescopic dipperstick means 86. Two boom cylinders 88 (one not shown) are disposed about the boom 80 having one end pivotally connected to an upper pin hinge 90 on the bracket 78 and the other end pivotally connected to the boom substantially intermediate its ends. A dipperstick cylinder 92 has a first end pivotally connected to the backhoe bracket 78 or other suitable location on the rotary tub 74 and a second end is pivotally connected to an upper end hinge pin connection 94 disposed substantially above the hinge pin connection 84 between the boom 80 and the dipperstick 86. A backhoe bucket cylinder 96 has a first end pivotally connected to the upper side of dipperstick 86 at a location disposed between the upper end hinge pin connection 94 and the intermediate hinge pin connection 84. The second end of the backhoe bucket cylinder 96 is pivotally connected at a hinge pin 98 to a guide link means 100 having a first end pivotally secured to a backsheet of a backhoe bucket 102 and a second end pivotally secured by a hinge pin 104 at a location adjacent a second end of the dipperstick 86. The backhoe bucket at a lower rearward location on its backsheet is pivotally secured by a hinge pin connection 106 to a lower or outer end of the dipperstick 86.

It will be seen that by selective cooperative extension and retraction of the boom cylinders 88, the dipperstick cylinder 92 and the bucket cylinder 96, it is possible to angulate the backhoe assembly 16 into any number of positions within a vertical plane of orientation so that a plurality of earth moving operations are accomplished, including but not limited to digging ditches, collecting dirt in the bucket, rotating the linkage members in a manner that permits loading the dirt in a truck, and the like.

The bearing mechanism 72 is connected all around its periphery with the undercarriage 76, both powered by hydraulic motor means 77 in a manner that permits complete 360 degree rotation of the cab 14 about the main frame 26 which in turn serves to react against forces that occur during manipulation of the boom 80 and the dipperstick 86 in digging, lifting and loading earth to trucks for movement away from a job site.

It should be noted that at least two devices 108 are disposed on either side of a forward portion of the main frame 26 so as to be adaptable to intercept the backhoe 16 if it is rotated forwardly with its boom 80, dipperstick 86 and bucket 102 in a manner that would cause a collision with the front end loader assembly and/or the engine enclosure 18 and main frame 26. The sensors 108 are connected by suitable means to the hydraulic control system that operates the backhoe 16 to disenable the control system and shut down the cab from rotating until such time as the backhoe 16 can be raised to clear any front end obstruction.

It will be noted that an operator's seat 110 is preferably mounted on a pedestal-like supporting mechanism adaptable to swivel 180 degrees from front to back so as to permit operation of either the front end loader bucket 12 or the backhoe assembly 16. A simple latch engaging arrangement serves to hold the seat in a forward or rearward position and to permit selective positioning therebetween.

In operation of the invention, there is provided a system of hydraulic and/or electric controls (not shown) that by selective operation thereof serves to raise and lower the boom 80; telescope it outwardly and inwardly; raise, lower and telescope the dipperstick 86; and rotate the bucket 102 to dig and hold therein a quantity of earth. In this control system there are provided at least two wobble sticks 112 that may be placed in at least four operative positions for manipulation of the boom, dipperstick and bucket. In addition, a unique arrangement mounted on each wobble stick comprising first 114 and second 116 twist grip motor mechanisms, similar to that employed on motorcycles, is utilized to effect outward and inward telescoping action of both the boom and the dipperstick. The front end loader assembly is also controlled by a wobble stick device that operates the hydraulic control system to raise and lower the lift arms 56 and to rotate the bucket 12 so as to scrape, push and/or load dirt into the bucket 12.

The several stabilizing arms 28, 32, 42, 46 are each controlled separately by a hydraulic or other suitable control system (not shown) to cause the arms to move inwardly, outwardly and to rotate forwardly and backwardly as arms 28 and 32 are capable of doing. The inward, outward and rotative movement of the arms is accomplished preferably by electrical mechanical solenoid valves for operating motors in the hydraulic control system.

As can be well understood, in the operation of the invention, the machine 10 is driven to a suitable work site location, the front 40 and rear 24 stabilizing assemblies are manipulated to provide a solid, sturdy, rigid platform and the backhoe assembly 16 is operated to accomplish a desired task of moving earth. While the machine 10 is maintained in this position, it is possible to rotate the cab along with the backhoe assembly 16 a complete revolution of 360 degrees either in a clockwise or a counter clockwise direction when viewed from above as seen in FIG. 2. After completion of the work, the front and rear stabilizing assemblies are retracted and pivoted into a transport orientation, whereby the vehicle 10 then may be driven to a new job site.

Alternately, of course, it is possible to separately operate the front end bulldozer loader assembly in a conventional manner to scrape, push and/or load dirt. During this type of operation, the stabilizing means is carried in a transport orientation and the backhoe attachment is inoperative.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An earth moving machine comprising:

movable frame means having a front wheel assembly and a rear wheel assembly providing support structure for the machine, and powered by engine means, self contained cab assembly means disposed on said frame means including an operator's work station located at an elevation above the height of said rear wheel assembly, said cab assembly means selectively operable to rotate 360 degrees upon said frame means, said cab assembly means comprising:

a cab, bottom side means disposed directly below and underneath said cab and forming a bottom end portion of said cab assembly means, circular undercarriage means secured to said bottom side means operable to support said cab assembly means during rotational movement thereof, said undercarriage means having a central vertical axis disposed rearwardly from a horizontal axis of the rearwardly disposed wheels of said machine, said cab, said operator's work station, said bottom side means and said undercarriage means effective to rotate said 360 degrees as a discrete unit, backhoe attachment means secured to a rear end portion of said cab assembly means so as to form a unitary construction therebetween, mounting pad means disposed directly above and fixedly secured to an upper side portion of said frame means, bearing adapter means disposed directly upon and fixedly secured to said mounting pads means and disposed directly below and underneath said undercarriage means, circular bearing means disposed upon said bearing adapter means for receiving said undercarriage means for rotational movement thereon, and hydraulic motor means coupled to said discrete unit to cause selective 360 degrees rotation of said cab assembly means so as to permit digging and movement of earth by said backhoe attachment means at either the rear of front ends of the machine or at any desired position therebetween, said machine further comprising loader bucket assembly means disposed at a front end portion of said frame means operable for manipulation thereat.

2. An earth moving machine as claimed in claim 1 comprising first stabilizing means mounted at a front end of said frame means operable to telescopically extend outwardly and inwardly relative to a longitudinal axis of the machine, and second stabilizing means mounted at a rear end of said frame means operable to telescopically extend outwardly and inwardly relative to said longitudinal axis of the machine.

3. An earth moving machine as claimed in claim 2 wherein said first and second stabilizing means comprise outer pivotable arms operable to rotate downwardly whereby each of said arms is effective to engage a surface of earth.

4. An earth moving machine as claimed in claim 3 wherein said second stabilizing means comprises horizontal beam means having inner ends pivotally connected to said frame means so as to effect horizontal angulation of said beam means in a direction rearwardly from said machine.

5. An earth moving machine as claimed in claim 4 comprising foot pad means disposed at an outer end of each of said arms of said stabilizing means to engage said surface of earth.

6. An earth moving machine as claimed in claim 3 comprising hydraulic motor means for selective operative control of said pivotable arms between a transport carry position and engagement of said surface of earth.

7. An earth moving machine as claimed in claim 1 comprising operator's seat means disposed within said operator's work station operable to swivel 180 degrees to permit operation of both said backhoe attachment means and said loader bucket assembly.

8. An earth moving machine as claimed in claim 7 comprising control system means disposed adjacent said operator's seat means for operation of said backhoe attachment means.

9. An earth moving machine as claimed in claim 8 wherein said backhoe attachment means comprises boom means and dipperstick means, and said control system means comprises separate wobble stick means respectively controlling operation of said boom means and said dipperstick means of said backhoe attachment means.

10. An earth moving machine as claimed in claim 8 wherein said backhoe attachment means comprises boom means and dipperstick means, and said control system means comprises twist grip mechanism means for respective selective outward and inward telescopic movement of said boom means and said dipperstick means of said backhoe attachment means.

11. An earth moving machine comprising movable frame means having a front wheel assembly and a rear wheel assembly providing support structure for the machine, and powered by engine means, loader bucket assembly means disposed at a front end portion of said frame means operable for manipulation thereat, self contained cab assembly means disposed on said frame means including an operator's station located at an elevation above the height of said rear wheel assembly, said cab assembly means selectively operable to rotate 360 degrees upon said frame means, bottom side means disposed directly below and underneath a cab of said cab assembly means and forming a bottom side thereat, circular undercarriage means disposed directly beneath said bottom side means operable to support said cab assembly means during rotation movement thereof, said cab assembly means, said operator's work station, said bottom side means and said undercarriage means effective to rotate said 360 degrees as a discrete unit, backhoe attachment means secured to a rear end portion of said cab assembly means so as to form a unitary construction therebetween, mounting pad means disposed directly above and fixedly secured to an upper side portion of said frame means, bearing adapter means disposed directly upon and fixedly secured to said mounting pad means, circular bearings means disposed upon said bearing adapter means for supporting said undercarriage means for rotational movement, hydraulic motor means coupled to said discrete unit to cause selective 360 degrees rotation of said cab assembly means so as to permit digging and movement of earth by said backhoe attachment means at either the rear or front ends of the machine or at any desired position therebetween, and sensor means disposed on opposite sides at forward locations on said frame means to disenable rotational movement of said cab assembly means in the event said backhoe attachment means encounters interference with said forward locations.

12. An earth moving machine as claimed in claim 11 comprising first stabilizing means mounted at a front end of said frame means operable to telescopically extend outwardly and inwardly relative to a longitudinal axis of the machine, and second stabilizing means mounted at a rear end of said frame means operable to telescopically extend outwardly and inwardly relative to said longitudinal axis of the machine.

13. An earth moving machine as claimed in claim 12 wherein said first and second stabilizing means comprise outer pivotable arms operable to rotate downwardly whereby each of said arms is effective to engage a surface of earth.

14. An earth moving machine as claimed in claim 13 comprising hydraulic motor means for selective operative control of said pivotable arms between a transport carry position and engagement of said surface of earth.

15. An earth moving machine as claimed in claim 11 comprising operator's seat means disposed within said operator's station operable to swivel 180 degrees to permit operation of both said backhoe attachment means and said loader bucket assembly.

16. An earth moving machine comprising movable frame means having a front wheel assembly and a rear wheel assembly providing support structure for the machine, and powered by engine means, self contained cab assembly means disposed on said frame means including an operator's work station located at an elevation above the height of said rear wheel assembly, said cab assembly means selectively operable to rotate 360 degrees upon said frame means, bottom side means disposed directly below and underneath said cab and forming a bottom side of said cab assembly means, circular undercarriage means disposed directly beneath said bottom side means operable to support said cab assembly means during rotational movement thereof, said undercarriage means having a central vertical axis disposed rearwardly from a horizontal axis of the rearwardly disposed wheels of said machine, said cab assembly means, said operator's work station, said bottom side means and said undercarriage means effective to rotate said 360 degrees as a discrete unit, backhoe attachment means secured to a rear end portion of said cab assembly means so as to form a unitary construction therebetween, mounting pad means disposed directly above and fixedly secured to an upper side portion of said frame means, bearing adapter means and disposed directly upon and fixedly secured to said mounting pad means and disposed directly below and underneath said undercarriage means, circular bearing means disposed upon said bearing adapter means for receiving said undercarriage means for rotational movement thereon, hydraulic motor means coupled to said discrete unit to cause selective 360 degrees rotation of said cab assembly means so as to permit digging and movement of earth by said backhoe attachment means at either the rear of front end of the machine or at any desired angular orientation therebetween, said backhoe attachment means including telescoping boom means having a first end pivotally connected to bracket means secured to said rear end portion of said bottom side means of said cab assembly means for selective articulation thereabout, telescoping dipperstick means pivotally connected intermediate its ends to a second end of said boom means for selective articulation therebetween, bucket means pivotally connected at a second end of said dipperstick means operable to be selectively articulated thereabout, first hydraulic motor means connected to said bracket means and to said boom means for selective raising and lowering thereof, second hydraulic motor means connected to said bracket means and to said boom means for selective raising and lowering thereof, third hydraulic motor means connected between said dipperstick means and guide link means of said bucket means for selective rotation of the bucket means about said second end of said dipperstick means, and hydraulic means coupled to said first, second and third hydraulic motor means to effect individual control of each of said boom means, said dipperstick means and said bucket means, said machine further comprising loader bucket assembly means disposed at a front end portion of said frame means operable for manipulation thereat.

17. An earth moving machine as claimed in claim 16 comprising first stabilizing means mounted at a front end of said frame means operable to telescopically extend outwardly and inwardly relative to a longitudinal axis of the machine, and second stabilizing means mounted at a rear end of said frame means operable to telescopically extend outwardly and inwardly relative to said longitudinal axis of the machine.

18. An earth moving machine as claimed in claim 17 wherein said first and second stabilizing means comprise outer pivotable arms operable to rotate downwardly whereby each of said arms is effective to engage a surface of earth.

19. An earth moving machine as claimed in claim 16 comprising operator's seat means disposed within said cab assembly means operable to swivel 180 degrees to permit operation of both said backhoe attachment means and said loader bucket assembly.

20. An earth moving machine as claimed in claim 16 comprising first motor grip control means coupled to said boom means to effect selective outward and inward telescopic extension movement thereof, and second motor grip control means coupled to said dipperstick means to effect selective outward and inward telescopic movement thereof.

* * * * *